US010772778B2

(12) United States Patent
Hahn et al.

(10) Patent No.: US 10,772,778 B2
(45) Date of Patent: Sep. 15, 2020

(54) PATIENT REPOSITIONING SHEET AND SLING

(71) Applicant: Medline Industries, Inc., Northfield, IL (US)

(72) Inventors: Vince Hahn, Chicago, IL (US); Drew Phalen, Skokie, IL (US); Emily Berman, Park Ridge, IL (US); Hillary Epperson, Chicago, IL (US)

(73) Assignee: MEDLINE INDUSTRIES, INC., Northfield, IL (US)

( * ) Notice: Subject to any disclaimer, the term of this patent is extended or adjusted under 35 U.S.C. 154(b) by 486 days.

(21) Appl. No.: 15/496,363

(22) Filed: Apr. 25, 2017

(65) Prior Publication Data

US 2018/0303690 A1 Oct. 25, 2018

(51) Int. Cl.

| | |
|---|---|
| ***A61G 7/10*** | (2006.01) |
| ***A61G 7/057*** | (2006.01) |
| ***A61G 7/00*** | (2006.01) |

(52) U.S. Cl.

CPC ..... *A61G 7/1026* (2013.01); *A61G 7/05715* (2013.01); *A61G 7/1017* (2013.01); *A61G 7/1055* (2013.01); *A61G 7/001* (2013.01); *A61G 7/1046* (2013.01)

(58) Field of Classification Search

CPC .. A61G 7/1013; A61G 7/1017; A61G 7/1023; A61G 7/1025; A61G 7/1026; A61G 7/1049; A61G 7/1051; A61G 7/1055; A61G 7/1057; A61G 7/057

USPC .... 5/85.1, 81.1 R, 83.1, 87.1, 89.1, 81.1 HS, 5/81.1 T

See application file for complete search history.

(56) References Cited

U.S. PATENT DOCUMENTS

| | | | |
|---|---|---|---|
| 5,067,189 | A | 11/1991 | Weedling |
| 5,442,821 | A | 8/1995 | Weeks |
| RE35,299 | E | 7/1996 | Weedling et al. |
| 5,561,873 | A | 10/1996 | Weedling |

(Continued)

FOREIGN PATENT DOCUMENTS

| | | |
|---|---|---|
| EP | 0913138 | 5/1999 |
| WO | 2012103232 | 8/2012 |
| WO | 2012170934 | 12/2012 |

OTHER PUBLICATIONS

PCT Search Report and Written Opinion from International Application No. PCT/US2018/017948 dated Jun. 27, 2018; 15 pages.

(Continued)

*Primary Examiner* — Robert G Santos

(74) *Attorney, Agent, or Firm* — Fitch, Even, Tabin & Flannery LLP

(57) ABSTRACT

A patient repositioning apparatus doubles as a repositioning sheet and a sling. The repositioning apparatus includes a sheet with an upper surface and an opposing lower surface and defines an outer periphery that has opposing side edges. The upper surface of the sheet has an upper surface material, and the lower surface of the sheet has a lower surface material that is formed from a relatively low-friction material as compared to the upper surface material. The handles are disposed along the opposing side edges of the sheet, and the strap members are attached to the sheet and distributed across both opposing side edges. Each of the strap members includes a strap portion that forms a bight in the strap member.

21 Claims, 13 Drawing Sheets

(56) References Cited

U.S. PATENT DOCUMENTS 6,073,291 A 6/2000 Davis
6,898,809 B2 5/2005 Davis
7,028,350 B1 4/2006 Davis
7,107,641 B2 9/2006 Davis
7,114,204 B2 10/2006 Patrick
7,168,115 B2 1/2007 Davis
7,210,176 B2 5/2007 Weedling
7,243,382 B2 7/2007 Weedling
7,266,852 B2 9/2007 Davis
7,337,477 B2 3/2008 Scordato
7,373,680 B2 5/2008 Davis
7,376,995 B2 5/2008 Davis
7,406,723 B2 8/2008 Davis
7,415,738 B2 8/2008 Weedling
7,467,431 B2 12/2008 Weedling
7,565,709 B2 7/2009 Davis
7,574,761 B2 8/2009 Davis
7,627,910 B2 12/2009 Davis
7,650,654 B2 1/2010 Lambarth
7,681,262 B2 3/2010 Weedling
7,712,170 B2 5/2010 Davis
7,735,164 B1 6/2010 Patrick
7,739,758 B2 6/2010 Weedling
7,849,533 B1 * 12/2010 Receveur ..... A61G 7/0504 5/497
7,861,335 B2 1/2011 Deluca
7,900,299 B2 3/2011 Weedling
7,975,330 B2 * 7/2011 Receveur ..... A61G 7/05784 5/691
8,006,333 B2 8/2011 Genaro
8,201,292 B2 6/2012 Dionne
8,234,727 B2 8/2012 Schreiber
8,276,222 B1 10/2012 Patrick
8,387,177 B2 3/2013 Davis
8,397,326 B2 3/2013 Lafleche
D690,424 S 9/2013 Ponsi
8,566,977 B2 10/2013 Davis
8,656,529 B2 2/2014 Corriveau
8,756,725 B2 6/2014 Piegdon
8,776,290 B2 7/2014 Wilkinson
8,782,826 B2 7/2014 White
8,789,533 B2 7/2014 Steffens
8,832,885 B2 9/2014 Lafleche
8,850,634 B2 10/2014 Ponsi
8,856,992 B2 10/2014 Lafleche
8,887,326 B2 11/2014 Patrick
8,910,325 B2 12/2014 Faucher
8,911,387 B2 12/2014 Lafleche
8,984,681 B2 3/2015 Ponsi
9,101,521 B2 8/2015 White
9,114,050 B2 8/2015 White
9,125,777 B2 9/2015 Patrick
9,132,052 B2 9/2015 Fowler
9,156,656 B2 10/2015 Rosenthal
9,222,498 B2 12/2015 Faucher
9,241,580 B2 1/2016 Patrick
9,278,038 B2 3/2016 Masucci
9,314,388 B2 4/2016 Patrick
9,414,977 B2 8/2016 Ponsi
9,421,140 B2 8/2016 Faucher
9,427,367 B2 8/2016 White
9,456,944 B2 10/2016 Berg
9,693,919 B2 * 7/2017 Berman ..... A61G 7/1051
9,693,920 B2 * 7/2017 Fowler ..... A61G 7/001
9,782,312 B2 10/2017 Brubaker
9,820,902 B2 * 11/2017 Ponsi ..... A61G 7/001
9,820,903 B2 * 11/2017 Steffens ..... A61G 7/001
9,820,904 B2 11/2017 Lafleche
9,849,053 B2 * 12/2017 Rigoni ..... A61G 7/05715
9,861,544 B2 * 1/2018 Rigoni ..... A61G 7/05715
9,877,884 B2 * 1/2018 Berg ..... A61G 7/1051
10,039,680 B2 * 8/2018 Galbraith ..... A61G 7/1055
10,064,773 B2 * 9/2018 Rigoni ..... A61G 7/05715
10,117,800 B1 * 11/2018 Galbraith ..... A61G 7/1055
10,182,956 B2 1/2019 Stryker
10,244,994 B2 4/2019 Davis
10,398,614 B2 * 9/2019 Rigoni ..... A61G 7/1015
10,561,557 B2 * 2/2020 Emerson et al. ..... A61G 7/10
10,588,800 B2 * 3/2020 Fletcher et al. ..... A47C 31/10
10,624,806 B2 * 4/2020 Emerson et al. ..... A61G 7/10
2005/0028273 A1 2/2005 Weedling
2005/0034242 A1 2/2005 Davis
2005/0076437 A1 4/2005 Johnson
2006/0000016 A1 1/2006 Weedling
2006/0021133 A1 2/2006 Davis
2006/0282946 A1 12/2006 Meyer
2007/0006388 A1 1/2007 Townsend
2007/0240260 A1 10/2007 White
2007/0266494 A1 11/2007 Deluca
2008/0000028 A1 1/2008 Lemire
2008/0028516 A1 * 2/2008 Morishima ..... A61G 7/1051 5/89.1
2008/0120780 A1 5/2008 Genaro
2008/0141463 A1 6/2008 Dionne
2008/0209630 A1 * 9/2008 Kazala ..... A61G 1/01 5/81.1 T
2008/0263763 A1 10/2008 Butler
2008/0289102 A1 11/2008 Davis
2010/0229298 A1 9/2010 Davis
2010/0287698 A1 11/2010 Stryker
2011/0056017 A1 3/2011 Schreiber
2011/0072579 A1 * 3/2011 Receveur ..... A61G 7/1026 5/81.1 HS
2011/0289691 A1 12/2011 Lafleche
2011/0296623 A1 12/2011 Lafleche
2011/0296624 A1 12/2011 Lafleche
2011/0301516 A1 12/2011 Lafleche
2012/0186012 A1 7/2012 Ponsi
2012/0186013 A1 7/2012 Ponsi
2012/0186587 A1 7/2012 Steffens
2012/0210511 A1 * 8/2012 Davis ..... A61G 7/1028 5/81.1 R
2013/0042414 A1 2/2013 Schreiber
2013/0061396 A1 3/2013 Lafleche
2013/0205495 A1 8/2013 Ponsi
2013/0219628 A1 8/2013 Blanchard
2013/0227787 A1 9/2013 Herbst
2013/0318708 A1 12/2013 Wang
2014/0007353 A1 1/2014 Stryker
2014/0041114 A1 * 2/2014 Davis ..... A61G 7/1028 5/83.1
2014/0059780 A1 3/2014 Lafleche
2014/0304918 A1 10/2014 Steffens
2015/0000045 A1 1/2015 Lafleche
2015/0047121 A1 2/2015 Berg
2015/0074903 A1 * 3/2015 Berg ..... A61G 7/1051 5/83.1
2015/0101126 A1 4/2015 Reiners
2015/0143628 A1 * 5/2015 Fowler ..... A61G 7/001 5/81.1 T
2015/0342811 A1 12/2015 Wong
2016/0008194 A1 1/2016 Ponsi
2016/0095777 A1 * 4/2016 Berman ..... A61G 7/1051 5/81.1 T
2016/0331611 A1 11/2016 Ponsi
2016/0367422 A1 12/2016 Weedling
2016/0374883 A1 12/2016 Galbraith
2017/0049646 A1 2/2017 Rigoni
2017/0049647 A1 2/2017 Rigoni
2017/0065476 A1 * 3/2017 Berg ..... A61G 7/1051
2017/0119608 A1 5/2017 Rigoni
2017/0143565 A1 5/2017 Childs
2017/0151112 A1 6/2017 Fletcher
2017/0172827 A1 6/2017 Schaaf
2017/0216117 A1 * 8/2017 Rigoni ..... A61G 7/05769
2017/0296414 A1 10/2017 Fowler
2017/0326011 A1 11/2017 Alvarez
2018/0049935 A1 * 2/2018 Rigoni ..... A61G 7/05715
2018/0071158 A1 3/2018 Lafleche
2018/0200130 A1 7/2018 Liu
2018/0250180 A1 9/2018 Phalen
2018/0303690 A1 * 10/2018 Hahn ..... A61G 7/1017
2018/0318162 A1 * 11/2018 Galbraith ..... A61G 7/1055

(56) References Cited

U.S. PATENT DOCUMENTS

| | | | | |
|---|---|---|---|---|
| 2018/0353360 | A1 | 12/2018 | Kea | |
| 2018/0369048 | A1 | 12/2018 | Rigoni et al. | |
| 2018/0369050 | A1 | 12/2018 | Davis | |
| 2019/0083341 | A1 | 3/2019 | Ulreich | |
| 2019/0091085 | A1 | 3/2019 | Emerson | |
| 2019/0091086 | A1 | 3/2019 | Emerson | |
| 2019/0091088 | A1 | 3/2019 | Emerson | |
| 2019/0201261 | A1 | 7/2019 | Galer | |
| 2019/0201262 | A1 | 7/2019 | Galer | |
| 2019/0216663 | A1 | 7/2019 | Ulreich | |
| 2019/0231624 | A1 | 8/2019 | Lafleche | |
| 2019/0380899 | A1* | 12/2019 | Rigoni | A61G 7/1063 |
| 2020/0078243 | A1* | 3/2020 | Berg et al. | A61G 7/10 |
| 2020/0129355 | A1* | 4/2020 | Emerson et al. | A61G 7/10 |

OTHER PUBLICATIONS

PCT Search Report and Written Opinion from International Patent Application No. PCT/US2018/025871 dated Aug. 13, 2018; 12 pages.

Images from Prevalon™ AirTAP System™ Demo, product video at https://www.youtube.com/watch?v=BtEaFrElfcU; Sage Products LLC; published on Aug. 9, 2016, 10 pages.

Transcription of and images from Prevalon® Turn & Position System product video at https://www.youtube.com/watch?v=VT82CV1couA; Sage Products LLC published on Dec. 10, 2013, 33 pages.

Transcription of and images of AirPal Air-Assisted Lateral Patient Transfer, product demo at https://www.youtube.com/watch?v=I7K5s_9Cr2c; AirPal, Inc.; published on May 1, 2014, 36 pages.

Transcription of and images of Comfort Glide™ Patient Repositioning System, product video at https://vimeo.com/90363103; Medline Industries, Inc.; publicly available at least as of Mar. 2014, 51 pages.

Transcription of and images of HoverMatt® Air Transfer System, product video at https://www.youtube.com/watch?v=8x6XmF5hgyg; CJ Medical; published on Oct. 15, 2014, 7 pages.

Images of Handicare's SystemRoMedic™—SafeHandlingSheet, date unknown.

Image of ArjoHuntleigh's Repositioning Sheet, date unknown.

Frontier Medical Group, "Automated Patient Turning Repositioned," (2018), 3 pages.

* cited by examiner

PATIENT REPOSITIONING SHEET AND SLING

TECHNICAL FIELD

This application is in the field of medical repositioning devices.

BACKGROUND

In medical environments, such as hospital intensive care units, caregivers and medical staffers may devote a significant portion of their time to moving and repositioning patients that are not capable of moving themselves. For example, to inhibit formation of pressure ulcers or bed sores in patients that are comatose or otherwise incapable of moving on their own accord, medical caregivers may be tasked with moving and/or repositioning these patients at regular intervals (e.g. every two hours). Moreover, some patients are not capable of moving by themselves, and caregivers may be asked to help move such patients from one location to another, for example, from a hospital bed to the toilet, and back again. This movement and repositioning can be a strenuous and even dangerous practice for the caregivers, particularly where the patient is heavy relative to the strength of the caregiver.

To help caregivers reposition patients, medical facilities may utilize repositioning sheets, such as the Comfort Glide™ repositioning sheet sold by Medline Industries. These repositioning sheets provide a soft upper surface that is comfortable for a patient to rest upon, a lower friction surface on an underside of the sheet, and handles that help the caregivers grasp the sheet. These features help the caregivers to slide the sheet and patient along a resting structure, such as a hospital bed, which makes the process of repositioning less burdensome for the caregiver.

Another technique that medical facilities employ to move or reposition a patent involves using a sling with a patient lift. Such slings can be placed underneath a patient, and strapped or otherwise engaged with a lifting device that uses a hoist to lift a patient off a resting structure, after which the patient can be moved, repositioned, or transferred to another resting structure.

While both the repositioning sheet and the lift/sling systems can be effective tools for moving patients, in certain situations one tool may be more effective than the other. For instance, where multiple caregivers (e.g., nurses) are present at a patient's side, and that patient is to be moved only a short distance, (e.g., from a supine to a partially recumbent resting position on a hospital bed), the repositioning sheet can provide a quick and efficient technique to achieve the movement that does not need to involve the use of the large lifting equipment. However, where the patient requires movement over a greater distance (e.g., transfer from a hospital bed to a wheelchair or an operating table), the sling/lift may be a more effective tool.

The present application describes tools and techniques that allow caregivers to have an option to choose which technique they need for the task at hand, and to perform the necessary repositioning or lifting without having to change the sheet beneath the patient.

DETAILED DESCRIPTION

Figure 1:
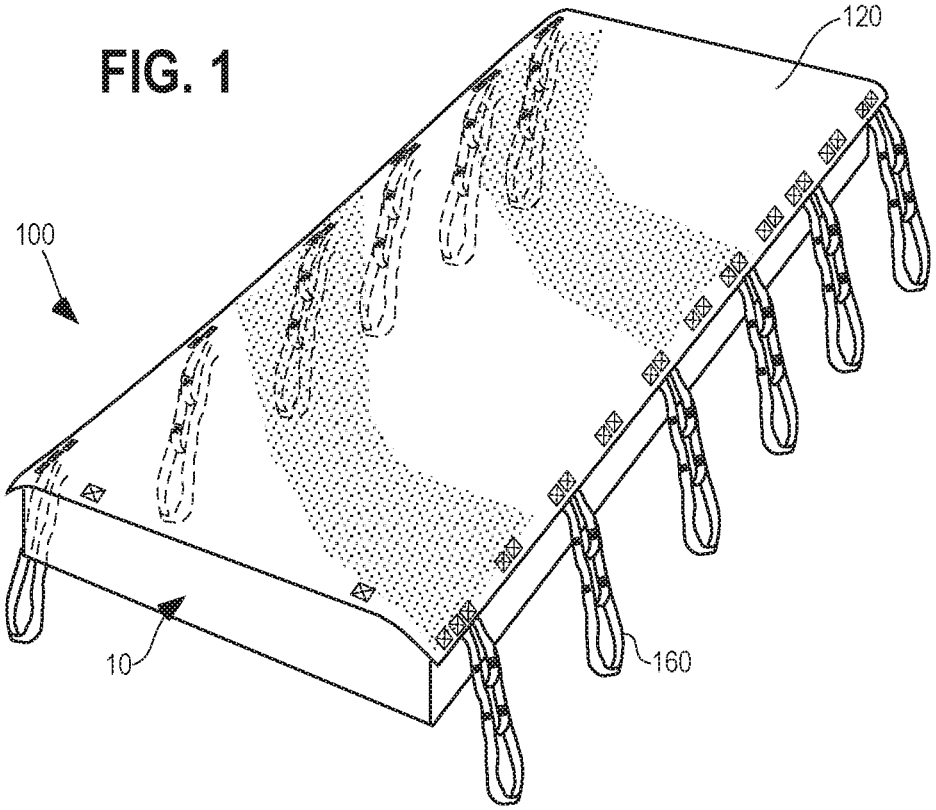
FIG. 1 is a perspective view of an exemplary patient repositioning apparatus disposed on a support structure.

This application describes examples of a patient repositioning apparatus that can serve as both a patient repositioning sheet and a patient sling. The patient repositioning apparatus includes a sheet with multiple handles and multiple strap members. The sheet has an upper surface and an opposing lower surface and defines an outer periphery that has opposing side edges. The upper surface of the sheet includes an upper surface material, and the lower surface of the sheet includes a lower surface material that is formed from a relatively low-friction material as compared to the upper surface material. The handles are disposed along the opposing side edges of the sheet, and the strap members are attached to the sheet and distributed across both opposing side edges. Each of the strap members includes a strap portion that forms at least one bight in the strap member, and preferably plural bights. The bight can be used to secure the strap member to a lifting device.

This application also describes kits that include patient repositioning apparatuses and other equipment. For example, the kits may include a patient repositioning apparatus as described above, and a lifting mechanism with mechanical hoist and a strap connector arm that has hooks sized to engage the strap members of the patient repositioning apparatus. Additionally and/or alternatively, a kit can include a wedge (or multiple wedges) that are configured to support a patient in a partially recumbent or reclined position. The wedge includes a base and an inclined portion. The materials forming the surfaces of the base and inclined portion can be selected to have similar or differing friction levels depending on the intended use of the wedge.

This application also describes examples of methods for repositioning and/or transferring a patient using the patient repositioning apparatuses described herein. The methods include positioning a repositioning apparatus (e.g., a patient repositioning apparatus as described above) on a resting structure, such as a hospital bed or gurney, and then positioning a patient on the repositioning apparatus. The methods may include using handles of the repositioning apparatus to move and/or slide the patient along a resting structure, or from one resting structure to another. The methods may also include repositioning the patient and the patient repositioning apparatus so that the patient rests in a recumbent position upon one or more inclined wedges, such as by rolling or sliding. Some methods also include engaging the strap members of the patient repositioning apparatus with a connector arm of a lifting mechanism, and lifting the patient. Once lifted, the patient can then be repositioned on the resting structure, or moved to another structure, such as a different hospital bed, a gurney, an operating table, or a wheelchair.

This application refers to relative friction levels among the various surfaces of a patient repositioning apparatus. Generally speaking, a friction level is dependent on a number of factors, including the material forming the surfaces of the sheet, the corresponding surface engaging with the sheet to generate the friction, and the normal force acting between the two surfaces. In this application, a "low friction" or "lower friction" surface is a relative term that refers to the relative frictional forces generated when two surfaces are tested under similar conditions. For example, to test the relative frictional forces between two surfaces, Surface A and Surface B, a 4 kg iron block may be placed onto each surface, and the dynamic and static frictional forces necessary to move or initiate movement the block are measured. Where the measured dynamic and/or static forces for Surface A are relatively low compared to those measured for Surface B, Surface A will be considered a relatively "low friction" surface, and Surface B will be considered a relatively "high friction" surface. In general, a "low friction" surface will generate a relatively low friction coefficient $\sigma$ compared to a "high friction" surface when tested using a similar iron block. It should be noted that the terms "high friction" and "low friction" are terms of relativity applied among multiple different materials, but these terms are not meant to convey any absolute value or range of values.

In general, surfaces formed from plastics, vinyl, and similar materials tend to make for good "low friction" surfaces that facilitate sliding and gliding along or between medical resting structures (e.g., hospital beds and gurneys). However, these materials tend to be cool, stiff, and uncomfortable, and do not generally make for a suitable surface that a patient can rest upon. Softer resting surfaces, such as those made from textiles, cloths, microfibers, and the like, will be generally more comfortable for a patient to rest upon. However, these softer surfaces tend to generate higher friction coefficients compared to those of the mentioned "low friction" materials. Accordingly, the patient repositioning apparatus may comprise multiple layers, each formed from a different material, so that the upper resting surface is formed from the softer high friction material, whereas the underside surface is formed from a sleeker, lower friction material. This higher friction, softer upper surface not only provides added comfort to a patient, but it also inhibits the unwanted slipping of the patient relative to the sheet during repositioning. In some embodiments, the low-friction material may be nylon and the high-friction material may be microfiber. It is not necessary that the low friction material be completely excluded from the upper surface, and thus, for example, the sheet may be composed of a sheet of high friction material secured to a slightly larger sheet of low friction material. Similarly, it is not necessary that the high friction material be completely excluded from the lower surface. Generally, other materials can be used in fashioning the sheet.

The patient repositioning apparatus may be of any suitable size and shape, and can be the same size as a standard sheet for a hospital bed or other support surface so that the repositioning apparatus can be fitted to the bed and serve as the bed sheet. The support surface may be any structure capable of supporting a resting patient. For example, the support surface can be a hospital bed (or a standard bed), a gurney, a wheelchair, a reclining chair, an operating table, or testing/scanning equipment (e.g., an X-ray or CAT scan device), to name a few options.

The term "patient repositioning apparatus" used throughout this application refers to a device that can operate as both a sheet and a sling. As such, this application may refer to the apparatus as either a "sheet" or a "sling," but any such references should not be limited to one particular functionality.

As shown in FIG. 1, the patient repositioning apparatus 100 includes a sheet 120 and strap members 160 extending therefrom. The strap members can be configured to attach with a variety of different lifting devices, although some embodiments may be particularly configured to work with a particular lifting device. The strap members may all be of the same length, or they may be of a variety of different lengths that allows for the apparatus 100 to attach to a lifting device in different lifting configurations designed to lift the patient in certain lifting positions. For instance, in some examples, the strap members are configured to engage with a lifting device so that the patient is lifted in a supine position, while other examples may allow for an engagement that lifts the patient in a seated position. Some embodiments may include strap members that are adjustable in length, or that are otherwise configured to engage with the lifting mechanism in a variety of different positions, thereby allowing for a variety of different lifting configurations. For example, the strap members may include multiple different bights or loops, each of which can engage with a lifting device at a different location, thereby allowing for flexibility in the manner that the lifting device raises the patient.

Figure 2:
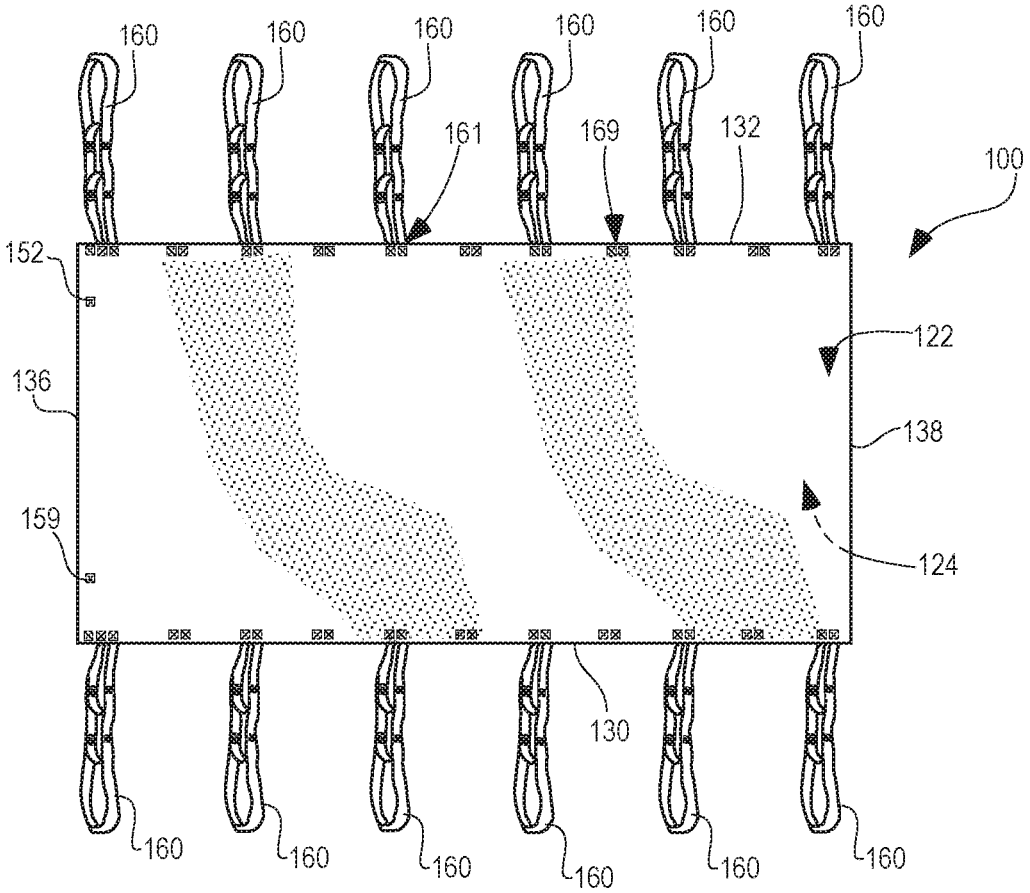
FIG. 2 is a top plan view of the patient repositioning apparatus of FIG. 1 with the strap members extended perpendicular to the side edges of the apparatus.

With reference to FIGS. 1 and 2 the strap members 160 are shown in FIG. 2 as extending perpendicular to the side edges 130/132 of the sheet 120. The sheet 120 can be sized to fit on a particular support structure or mattress, but the sheet 120 can also be of a non-specific size and can be used with a variety of different equipment. The sheet 120 is generally rectangular in shape, with opposing side edges 130/132 spaced apart from one another and extending between opposing top 136 and bottom edges 138. However, in other examples, a sheet may take on another shape, such as a triangular shape, a round or elliptical shape, or another polygonal shape, depended on the intended application of the sheet 120 and the corresponding structure that it is designed to work with.

The sheet 120 can be formed of a variety of materials, and in some embodiments, the sheet 120 includes multiple layers. The multiple layers form opposing sheet surfaces 122/124, each of which may be formed from different materials. For example, an upper surface 122 of the sheet 120 may be configured to provide a soft, comfortable surface for a resting patient, and may therefore be formed from softer high friction material such as cotton, microfiber or other textiles. Conversely, the opposing lower surface 124 may be formed from low friction material to facilitate sliding of the patient repositioning apparatus 100 on the resting structure 10. The lower surface 124 can be formed from a synthetic material, such as a plastic, vinyl, or the like.

The embodiment in FIGS. 1 and 2 shows a patient repositioning apparatus 100 with six strap members 160 extending from each side of the sheet 120, but different embodiments may have more or fewer strap members, depending on the lifting equipment used with the patient repositioning apparatus 100. For instance, some examples may have two, four, five, or eight strap members 160 extending from each side of the sheet 120. The strap members 160 may include a plurality of bights or loops (shown in more detail in FIG. 6), each of which provides a point for attaching to a lifting device. This multi-bight configuration allows flexibility in terms of the length of the strap member when attaching to a lifting device, and in particular allows the patient repositioning apparatus 100 to be used to support a patient in a generally seated position.

In some examples, each side of the sheet 120 may have a different number of strap members 160 extending therefrom. Further, some examples may have one or more strap members 160 extending from the upper 136 or lower 138 edges of the sheet 120, depending again on the corresponding equipment used with the patient repositioning apparatus 100.

The strap members 160 are configured to attach to the sheet 120 via securement locations 161 along the first and second side edges 130/132 of the sheet 120. The securement locations 161 may include two or more sealing points comprising stitching, welding, or another mode of attachment, and used to secure ends of the strap members 160 to the sheet 120, as described further below and shown in more detail in FIG. 6. The securement locations 161 may also serve to secure handles 140 (shown in FIG. 3) or portions of the handles 140 to the underside 124 of the sheet 120. The handles 140 may also be secured to the sheet 120 at intermediary securement locations 169 spaced between the securement locations 161 along the side edges of the sheet 120.

Some examples of the patient repositioning apparatus 100 may include retaining members (not shown) that extend from the sheet 120, which are configured to help hold or secure the patient repositioning apparatus 100 onto a resting structure. The retaining members may include bands, belts, or straps designed to wrap around a portion of the resting structure, and engagement structure, such as clips, buttons, snaps, hook and loop fasteners, or the like.

Figure 3:
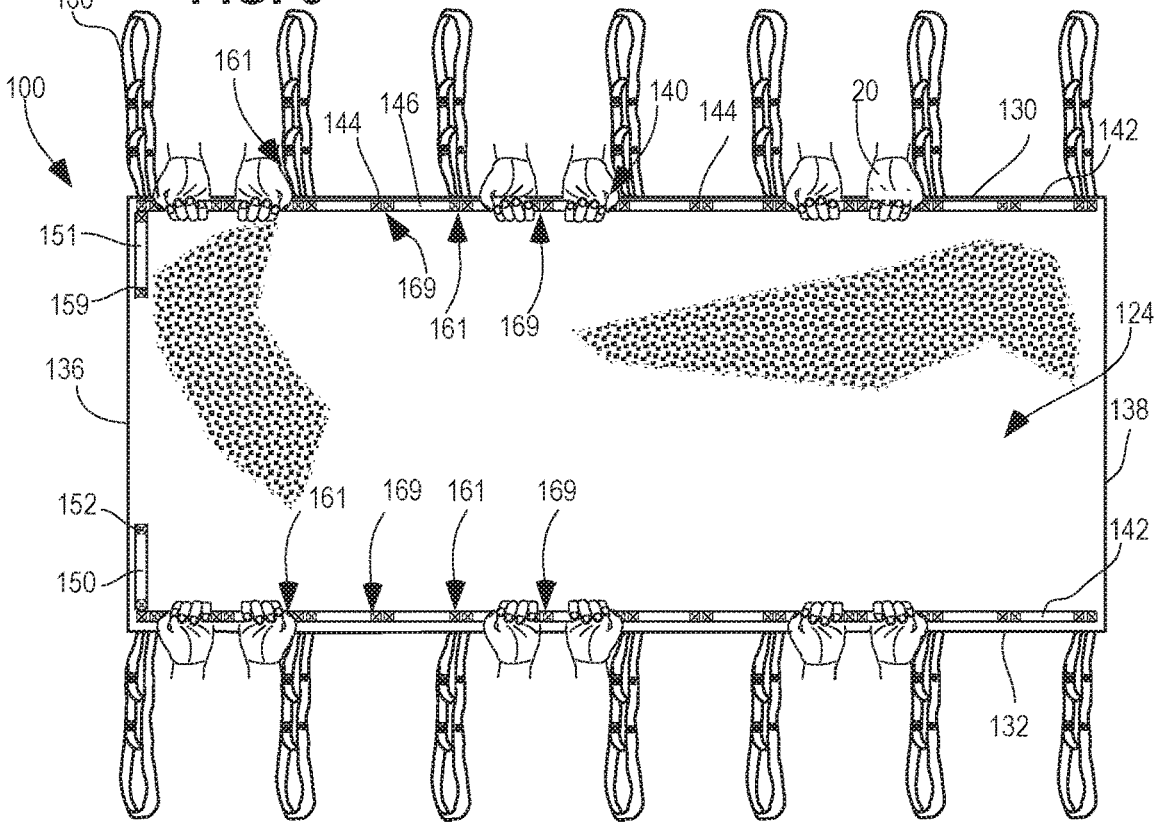
FIG. 3 is a bottom plan view of the patient repositioning apparatus of FIG. 1 showing handles disposed on an underside of the apparatus.

The patient repositioning apparatus 100 also includes one or more handles 140 on the underside of the sheet 120 that help a caregiver 20, or multiple caregivers, move and/or reposition the patient repositioning apparatus 100 on or between resting structures. As seen in FIG. 3 handles 140 are generally on an underside 124 of the sheet 120. The handles may be formed from a strip or band 142 that extends along the side edges 130/132 of the underside 124 of the sheet 120. The bands 142 are secured to the sheet 120 at various securement locations 161 and 169, each of which comprise sealing points 144 along the side edges 130/132 or periphery of the sheet 120. These sealing points 144 can be formed, for example, by stitching, welding, or adhering the band 142 to the sheet 120. For instance, the sealing points 144 can be formed by stitching a pattern comprising a boxed in "X," whereby the stitching passes through each of the sheet 120, the band 142, and/or a portion of a strap member 160. The handles 140 may be disposed on the same side edges as the straps 160, or on the intersecting top and bottom edges. In the illustrated embodiment, the patient repositioning apparatus 100 includes two handles 150 and 151 disposed on a top edge 136 of the sheet 120, the top edge 136 being intended for placement near the head of a patient when in use. The top handles 150 and 151 may be secured to the underside 124 of the sheet 120 at a location near the upper corners of the sheet 120, as well as at securement locations 152 and 159 located along the upper edge 136 inward from the corner.

Extending between the various sealing points 144, the band 142 will form an un-attached portion that serves as a gripping portion 146 of the handle 140. In this way, the patient repositioning apparatus 100 may include multiple handles 140 positioned along the entire length of the underside 124 of the sheet 120, thereby offering a caregiver a variety of options for gripping locations when moving a patient. The sealing points 144 can be arranged to affix both a portion of the handles 140 and a portion of the strap members 160 to the sheet 120, as shown with respect to securement locations 161, such that one stitching pattern secures both objects to the sheet 120. The handles can also attach to the sheet 120 via sealing points 144 placed at intermediary securement locations 169 between the securement locations 161 that affix the strap members 160 to the sheet 120, thereby providing multiple handles that offer multiple gripping locations along the sheet. In some examples, the patient repositioning apparatus 100 may also include a handle or handles 150/151 attached to the upper edge 136 of the sheet 120 (as shown in FIGS. 3 and 4), or to a lower edge 138 of the sheet 120.

In other examples, a patient repositioning apparatus may include only a single handle 140 on each side of the sheet 120, secured at two locations. In still other examples, each side of the sheet 120 may include a plurality of handles, each formed from a separate band or series of bands that are separately and individually attached to the underside of the sheet 120. In other examples, the handles 140 may be formed on the upper surface 122 of the sheet 120. In yet further examples, the handles 140 may be formed as a part of the sheet 120 itself, for instance, by way of slots cut into the sheet, or tabs, knobs, strips, or other features that extend from the sheet 120. And in embodiments where the sheet is a non-rectangular shape, the handles may be formed in the side edge or edges that define the outer peripheral shape of the sheet, such as the perimeter of a round or elliptical shaped sheet.

Figure 4:
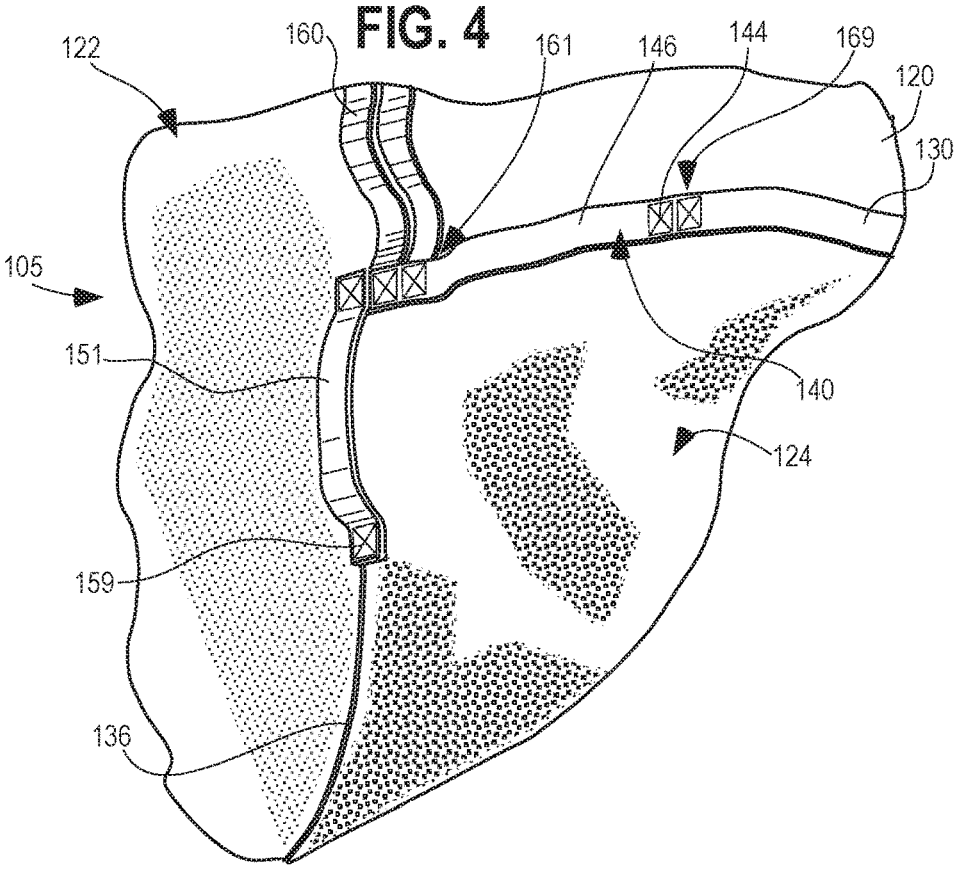
FIG. 4 is an enlarged view of a corner portion of the patient repositioning apparatus of FIG. 1 with the corner folded back showing different materials that form the opposing surfaces of the apparatus.

As shown in FIG. 4, corner portion 105 is folded back to show the opposing upper 122 and lower 124 surfaces of the sheet 120. As shown by the different texture patterns, the lower surface 124 is formed from a slicker, low friction material, and the upper surface 122 is formed from a softer, more comfortable material that is generally forms a higher friction surface. The folded corner 105 also shows a handle 140 extending along a side edge 130, and a second handle portion 150 positioned on the upper edge 136 perpendicular to the side edge 130. A strap member 160 is also secured to the sheet 120 at a securement location 161 that secures both the strap member 160 and a portion of a handle 140.

Figure 5:
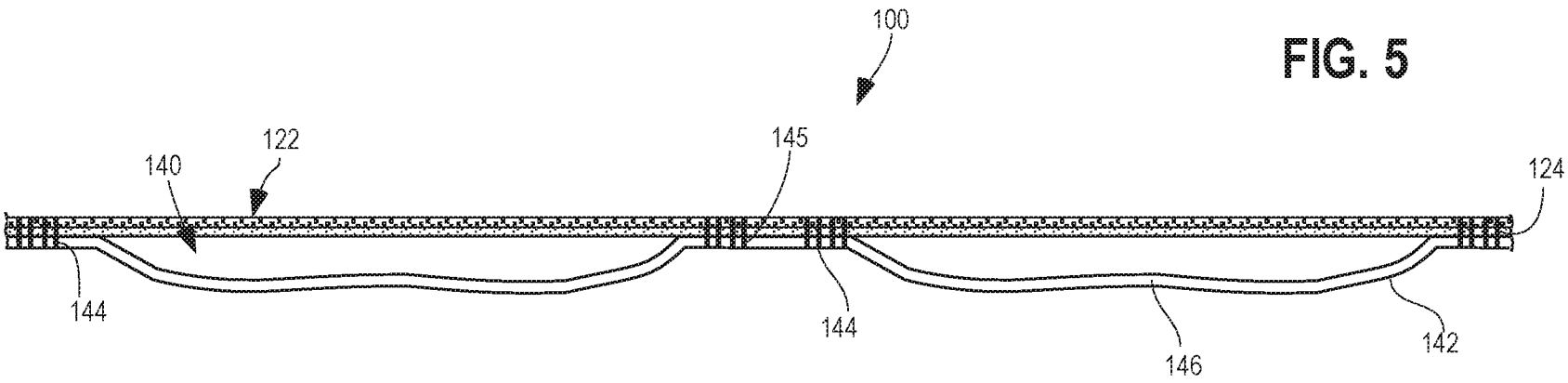
FIG. 5 is an enlarged elevational view of the apparatus of FIG. 1 showing the structure of the handles.

FIG. 5 depicts the band 147 secured to the underside 124 of the sheet 120 at sealing points 144, with the unsecured gripping portion 146 extending there between. The sealing point 144 can include stitching 145 that passes through one or more of the layers of the sheet 120, and the band material 142 that forms the handles 140.

Figure 6:
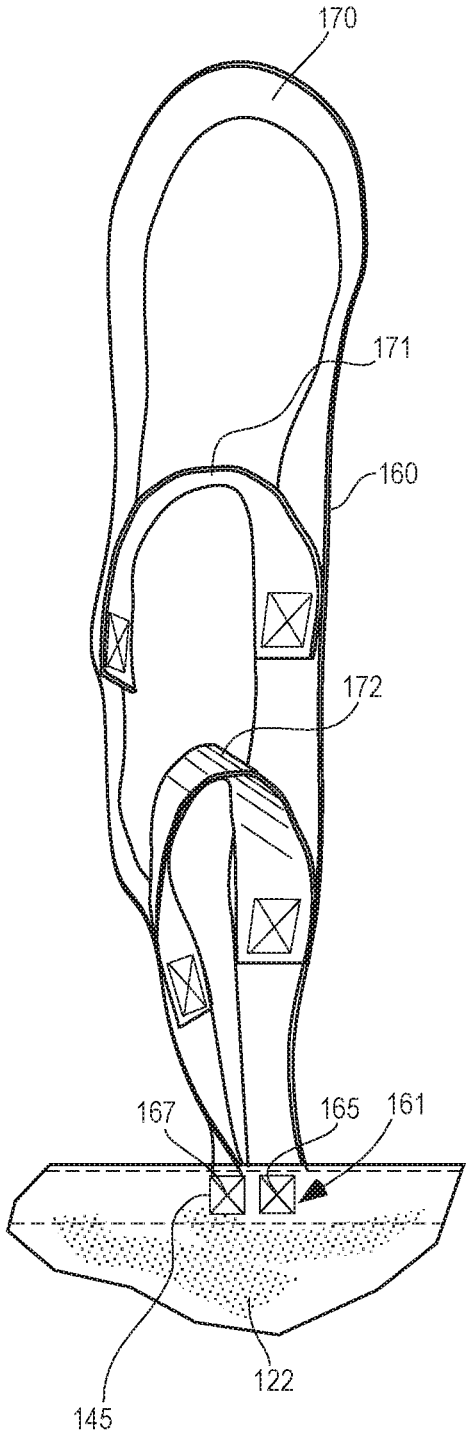
FIG. 6 is an enlarged perspective view of the strap member of the patient repositioning apparatus shown in FIG. 1, depicting multiple bights for securing to a lifting mechanism at different connection points.

The sealing points 144 securing the handles to the sheet 100 can also serve as the sealing points that attach the strap members 160 to the sheet 100 (for clarity, FIG. 5 removes the strap members 160 from view). For instance, FIG. 6 illustrates the attachment points 165/167 between the strap members 160 and the patient repositioning apparatus 100. The strap members 160 include a strap portion at one end that allow for attachment to a lifting device. That bight 170 is configured to engage with a hook or other similar structure on a lifting device. Opposite the bight 170, the strap member 160 is secured to the sheet 120 via two attachment points 165/167 that secure the end portions of the strap member 160 to the sheet 120. In the shown configuration, the attachment points 165/167 are formed via stitching 145, though other techniques could be used, such as via an adhesive or via a welding technique.

As shown in FIG. 6, the strap member 160 that includes multiple strap portions 170/171/172 for securing to a lifting device. Each strap portion is defined by a loop or bight that allows the strap member 160 to effectively operate at different lengths. This can allow for the patient repositioning apparatus 100 to connect to a lifting device in a variety of different lifting positions. For example, where it is desired to lift a patient in a reclined or seating position, shorter bights 171 or 172 are used adjacent the head of the patient and longer bights 170 or 171 are used adjacent the buttocks of the patient. While the strap members 160 shown and described with respect to this application include three separate strap portions or bights, other embodiments may use strap members 160 with more or fewer bights, depending on the intended use of the strap members, and the corresponding structure of the lifting mechanism. For example, some strap members may include four, five, or six bights, while others may include two or only one bight. Moreover, other examples may utilize other techniques for adjusting the length of a strap member 160, for example, by providing the strap member 160 as two separate bands that engage with one another via adjustable securing devices like clips, hooks, slide fasteners, buckles, buttons, hook and loop fasteners, and the like.

Figure 7:
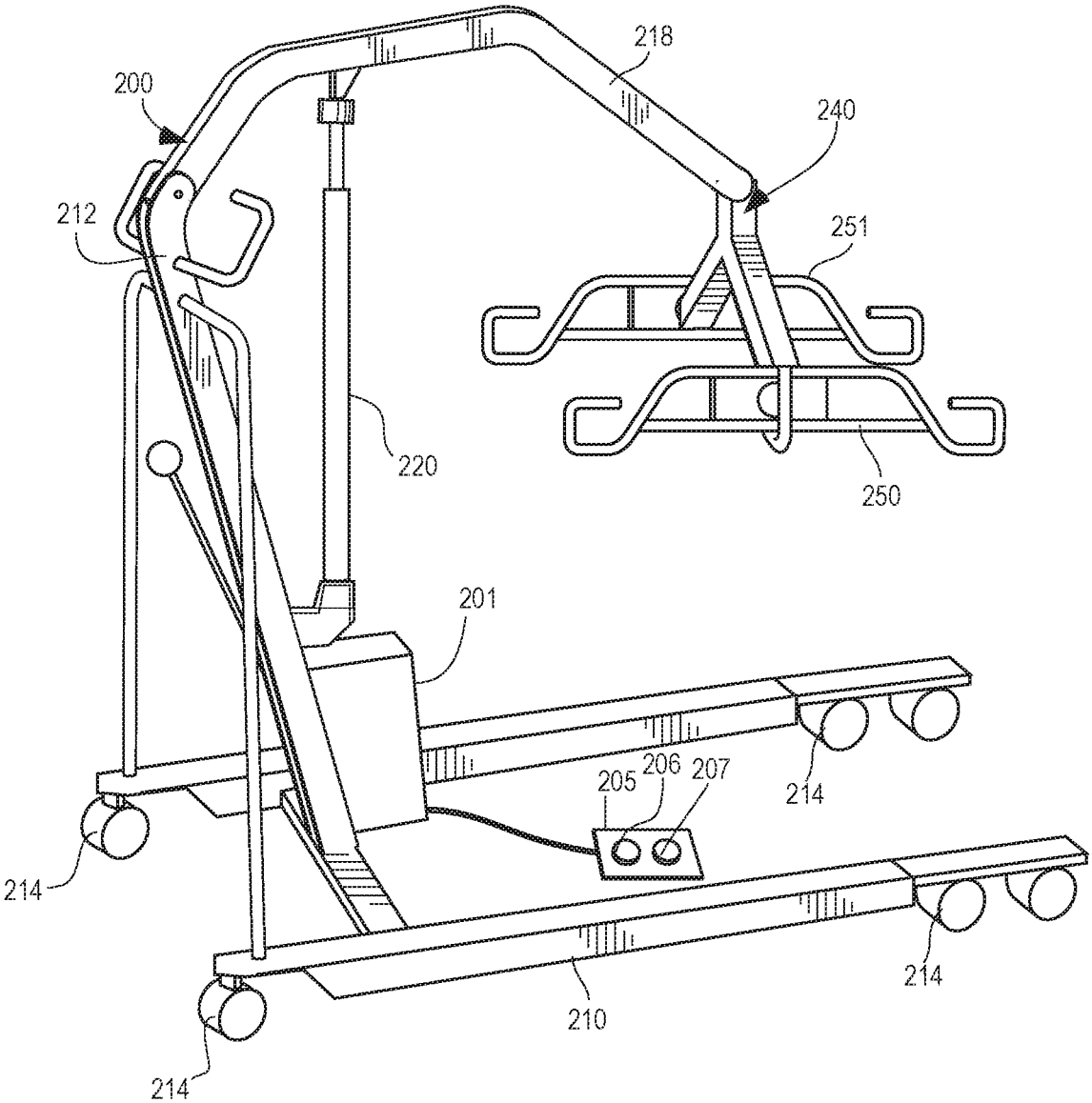
FIG. 7 is a perspective view of an exemplary lifting mechanism that can be used with the patient repositioning apparatuses described in this application.

In some forms, the patient repositioning apparatus 100 may be provided as a component of a kit that includes a lifting device, such as the lifting device 200 shown in FIG. 7. In the depicted example, the lifting device 200 includes a base 210 with wheels 214 that allow the lifting device 200 to be carted around between multiple locations. The lifting device 200 also has a vertical support structure 212, and a mechanical hoist 220 that causes a cross beam 218 to move up and down as desired. The hoist 220 may be hydraulic or otherwise configured. A connector arm 240 is connected to the end of the cross beam 218, and can operate with the patient repositioning apparatus 100. Two hook structures 250/251 attached to opposing ends of the connector arm 240. Each of the hook structures 250/251 comprise multiple hooks configured to engage with strap members 160 from a patient repositioning apparatus 100. The hook structure 250 is configured to engage with the strap members 160 that extend from the first side edge 130 of the sheet 120, and the second hook structure 251 is configured to engage with the strap members 160 extending from the opposing second side edge 132 of the sheet 120. A motor 201 configured with operator control may be provided to actuate the hoist 220. The control 205 may include an up button 206 and a down button 207 that activate movement of the hoist 220 upward and downward, respectively.

Figure 8:
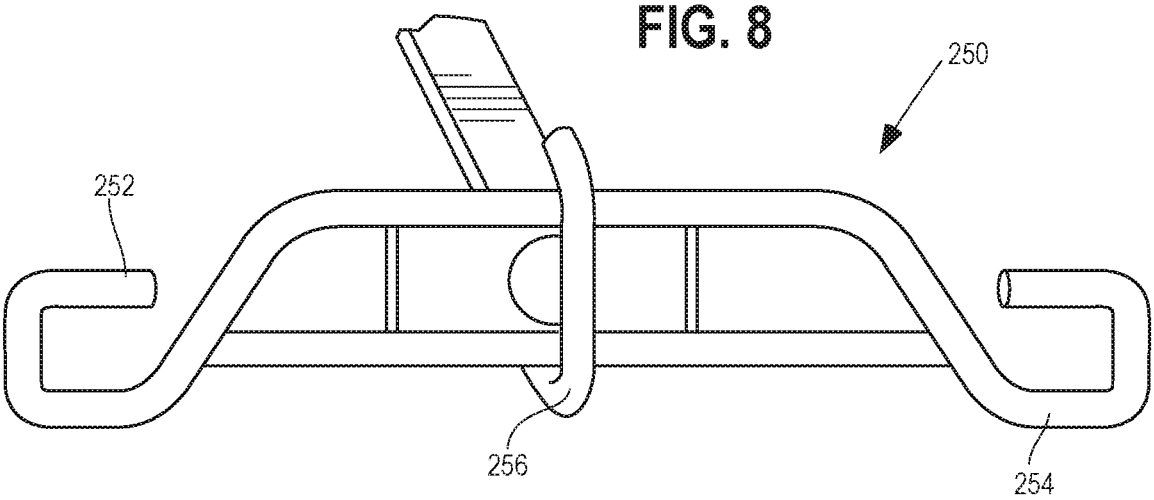
FIG. 8 is an enlarged perspective view of a strap connector arm of the lifting mechanism of FIG. 7.

FIG. 8 shows of one hook structure 250 of the connector arm 240 of the lifting device 200 of FIG. 7. The hook structure 250 comprises three separate hooks, including opposing end hooks 252/254, and a central hook 256 that protrudes perpendicular to the length of the hook structure 250. Each of the opposing end hooks 252/254 and the central hook 256 may be sized to engage with a strap location or a bight on a strap member 160 of a patient repositioning apparatus 100.

Figure 9:
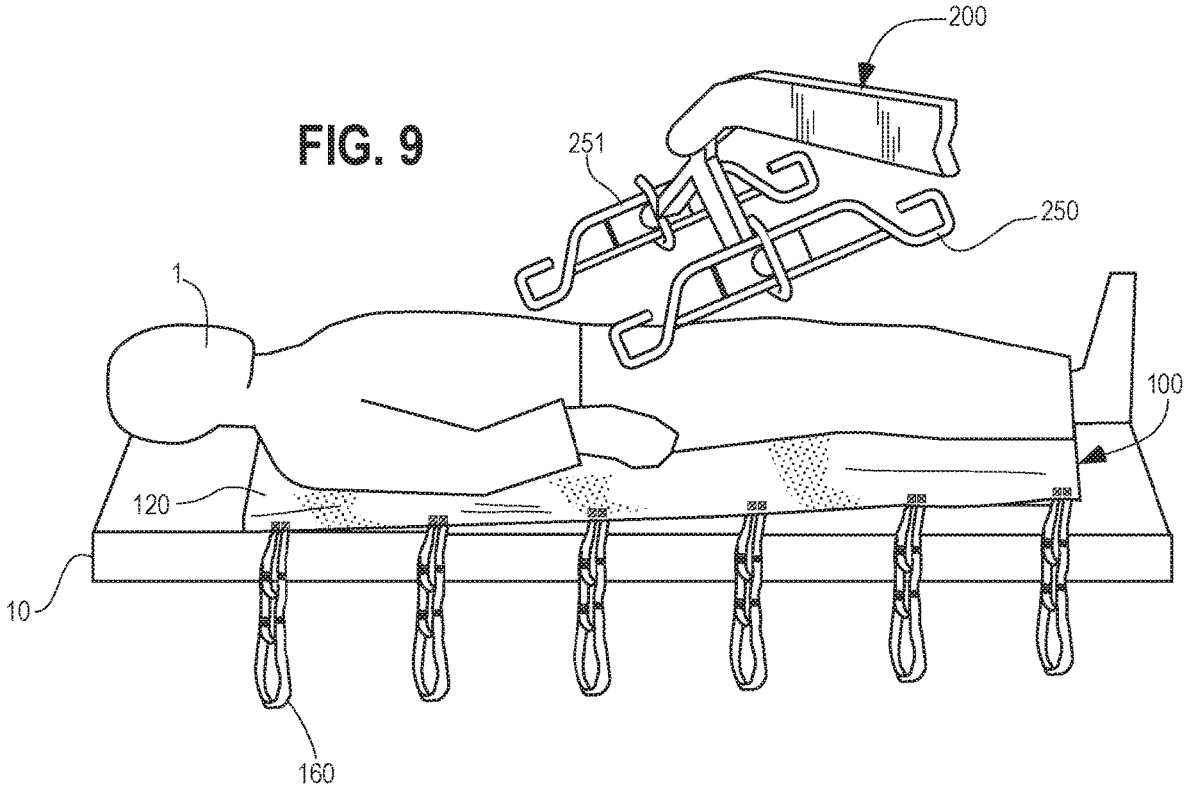
FIG. 9 illustrates a patient resting on a patient repositioning apparatus over a support surface with a lifting mechanism positioned adjacent the patient.
Figure 10:
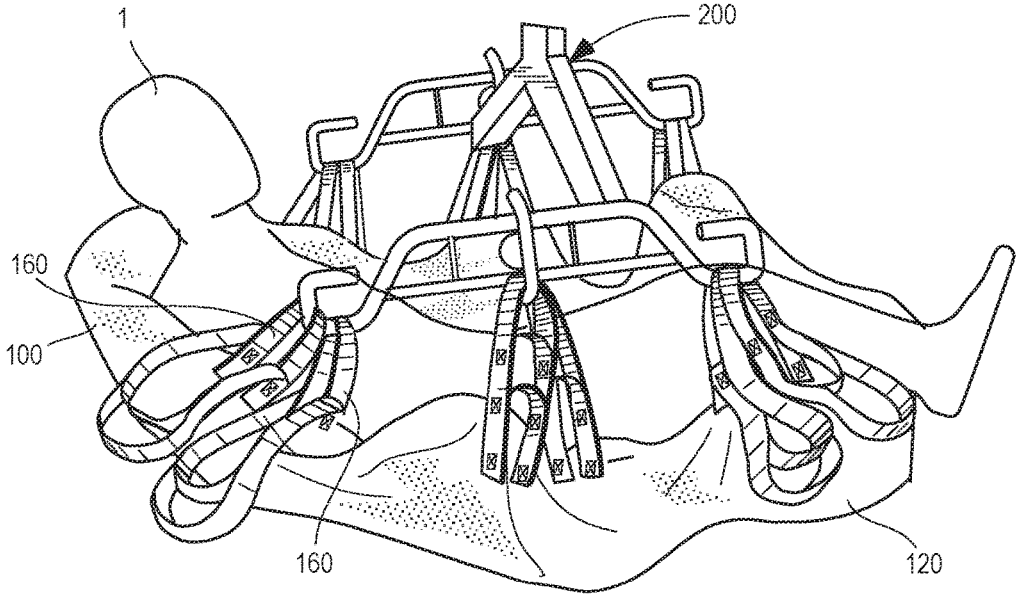
FIG. 10 illustrates the patient repositioning apparatus of FIG. 1 engaging with a lifting mechanism. This figure illustrates the patient still contacting the support surface but ready to be raised to a lifted position.

As seen in FIG. 9, a patient 1 rests on a patient repositioning apparatus 100, and the lifting device 200 of FIG. 7 is arranged over the patient prior to lifting. As shown, the lifting device 200 is arranged so that the connector arm 240 spans over the patient 1 so that the opposing hook structures 250/251 are arranged relative to the side edges of the patient repositioning apparatus 100. Continuing to FIG. 10, patient repositioning apparatus 100 is connected to the lifting mechanism 200 in preparation for lifting the patient. As shown, each of the strap members 160 is engaged with one of the hooks of the hook structures 250/251. As is known in the art, the smallest bight of the straps 160 is used near the head section of the patient, the largest bight is used near the buttocks of the patient, and the intermediate or smallest bight is used near the feet of the patient, to create a "seat" for the patient. At this point, the lifting device may be activated and the patient lifted from the support surface, and may be raised to the position shown in FIG. 11.

Figure 12:
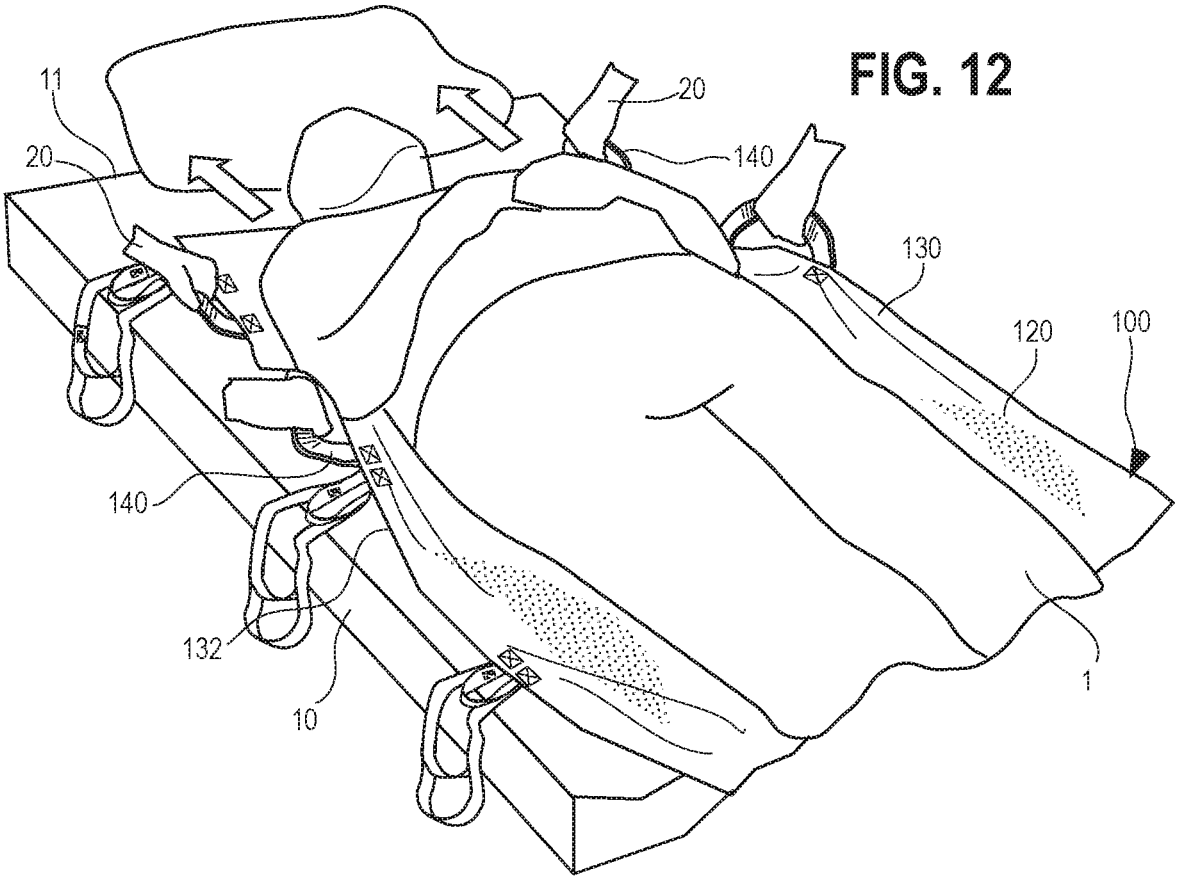
FIG. 12 is a perspective view of a patient resting on a patient repositioning apparatus while being repositioned relative to a hospital bed.

The patient repositioning apparatus 100 also may be used for patient repositioning without a lift, as shown in FIG. 12. As depicted, the patient 1 rests on a patient repositioning apparatus 100 while being repositioned relative to a hospital bed 10. In this example, medical caregivers (depicted with hands 20) are gripping the patient repositioning apparatus 100 via the handles 140 on the sides 130/132 of the sheet 120, and sliding the patient 1 toward a distal end 11 of a hospital bed 10. Because the underside of the sheet 120 is a low friction surface, the friction resistance between the sheet 120 and the mattress 10 is relatively low, which allows for easier repositioning of the patient 1.

The patient repositioning apparatus 100 described in this application can be used in a variety of environments, and in connection with a variety of other equipment and components. For example, the patient repositioning apparatus 100 can be used with a disposable dry pad that can be placed between the patient repositioning apparatus 100 and the patient 1 to absorb fluids and manage moisture that may develop between the patient and the patient repositioning apparatus 100.

Figure 13:
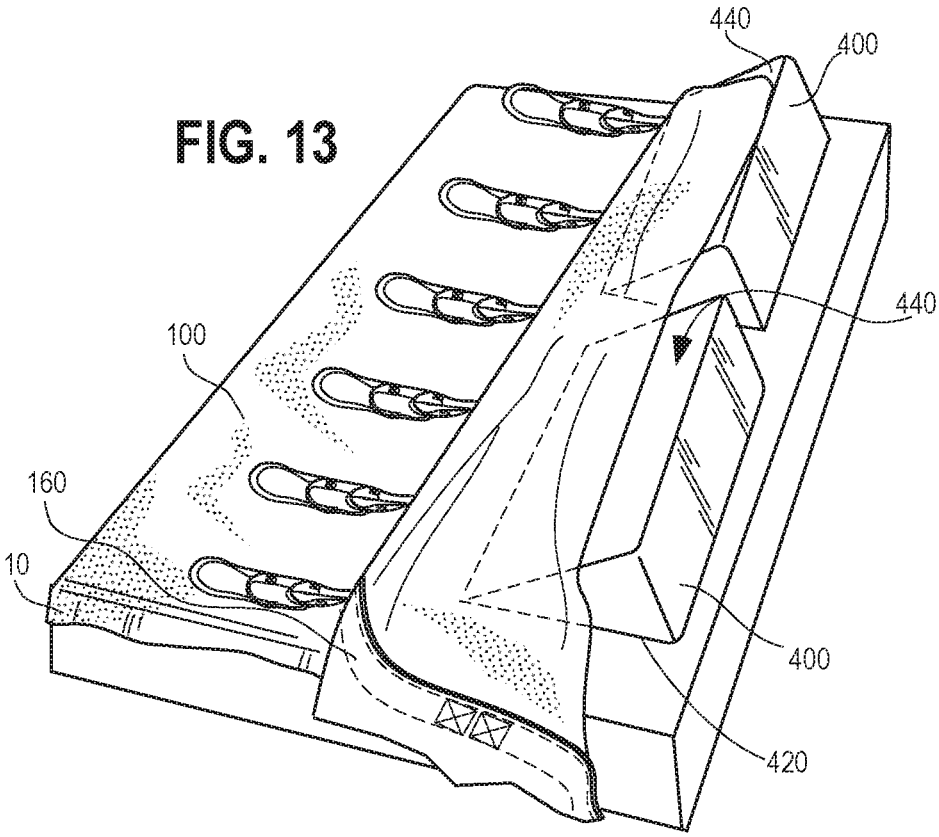
FIG. 13 depicts a patient repositioning apparatus and wedges on a hospital bed.

In some circumstances, the patient repositioning apparatus 100 can be used along with a system designed to assist continued movement and repositioning of the patient. Such systems can include wedges upon which the patient can be positioned to situate the patient in a partially recumbent position. As shown in FIG. 13, the patient repositioning apparatus 100 may be used with one or more wedges 400 on a hospital bed 10. These wedges 400 can be used, for example, on patients that must be moved and/or repositioned periodically to inhibit formation of bed sores on the patient 1. That is, the wedges 400 can be used to provide alternative positions for repositioning an immobile patient 1.

Figure 15:
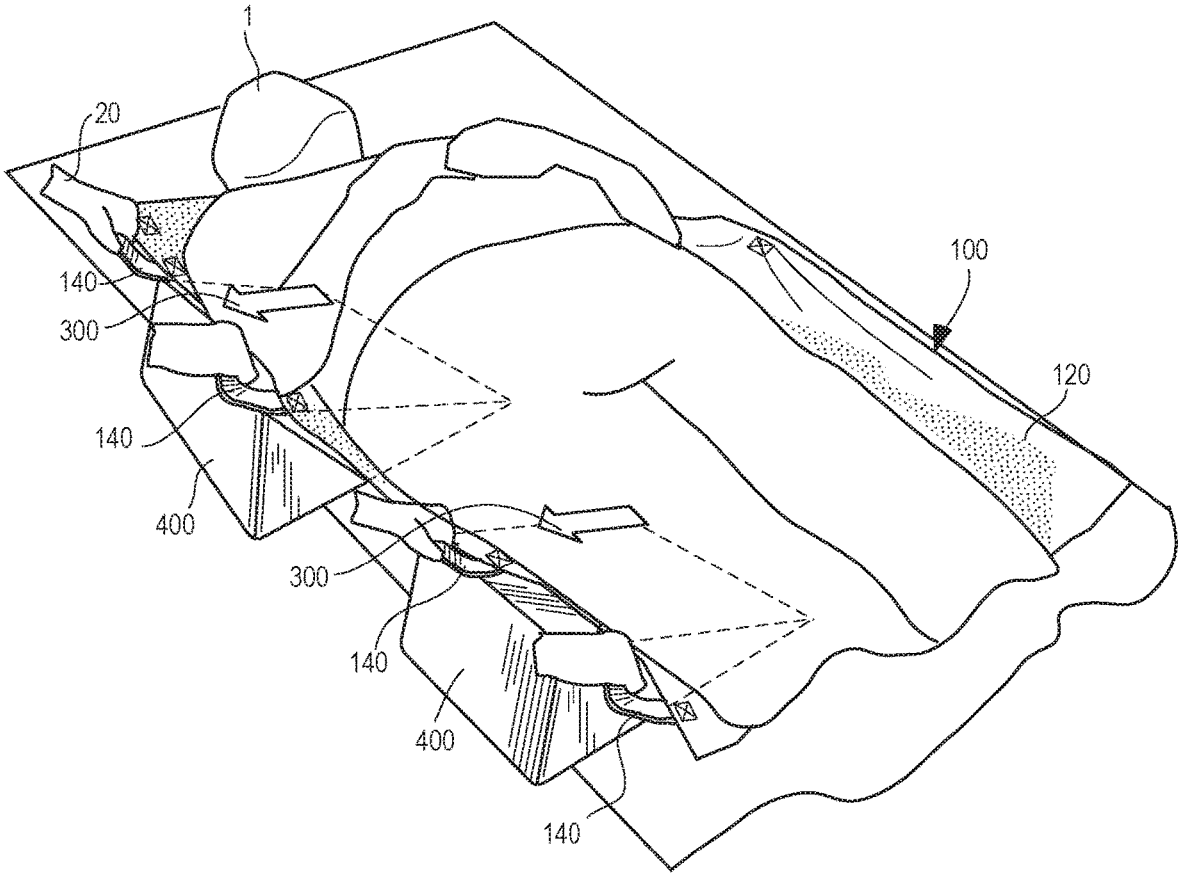
FIG. 15 depicts an example of a patient on a patient repositioning apparatus being slid into a recumbent position on a wedge.

The wedges 400 each have a base surface 420, which is designed to engage with the mattress of a hospital bed or other support surface, and an inclined surface 440, which supports the patient. The wedges 400 can be formed from a flexible material such as a foam, and can be provided in varying levels of stiffness. The base surface 470 comprises a generally high friction material to inhibit unwanted movement or sliding of the wedge 400 along a resting surface when a patient rests there upon. In some examples, the inclined surface 440 can include the same material that forms the base surface 420, but in other examples, the inclined surface 440 is formed from a low friction material relative to that of the base surface. Using such a low friction material on the inclined surface 440 can help a caregiver position a patient onto the wedge or wedges by sliding the patient and the repositioning apparatus up along the wedge. In such an embodiment, because the inclined surface 440 and the underside 124 of the patient repositioning apparatus 100 are relatively low friction materials, the caregiver will experience relatively low resistance when sliding the patient onto the wedge 400. In FIG. 15, the patient 1 is disposed on a patient repositioning apparatus 100 and is being slid by a caregiver into position on a wedge 400 in accordance with this technique. As shown, the patient is slid in the direction of arrows 300 to move the patient to a recumbent supported position.

Figure 14:
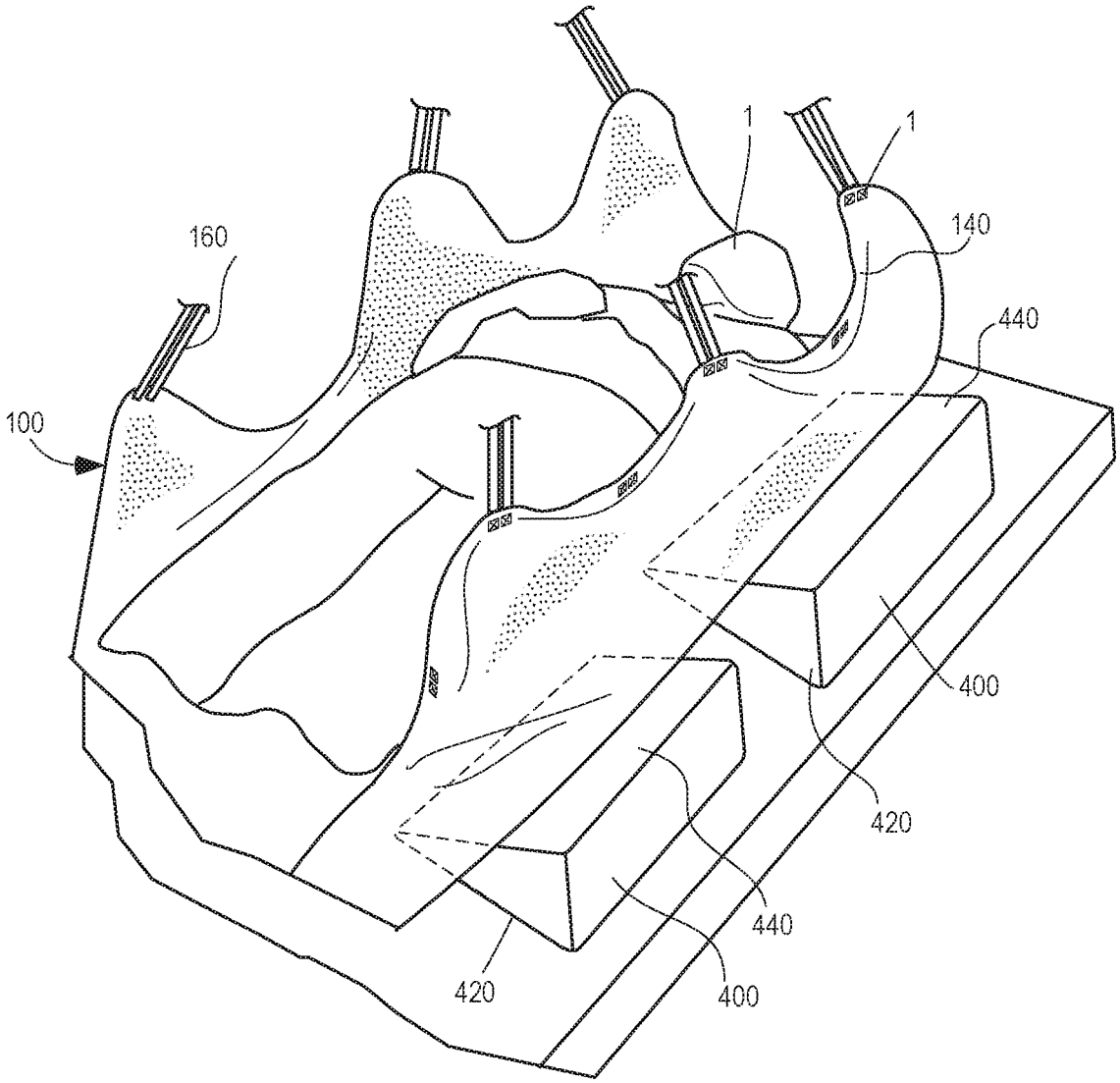
FIG. 14 shows a patient on the patient repositioning apparatus being lifted onto wedges for recumbent support in accordance with certain methods of using a patient repositioning apparatus described in this application.

In addition to the sliding technique shown in FIG. 15, the patient repositioning apparatus 100 can assist repositioning of a patient with respect to the wedges 400 via other techniques. For example, FIG. 14 shows a patient 1 on a patient repositioning apparatus 100 resting on a hospital bed 10. The patient repositioning apparatus 100 is engaged with a lifting device 200 via the strap members 160, and is thus being lifted slightly off the hospital bed 10. Wedges 400 are placed on the bed 10 beneath the elevated patient 1. From this position, the lifting mechanism 200 can lower the patient 1 and the patient repositioning apparatus 100 so that the patent 1 engages with the wedges 400 in a reclined or partially recumbent position. When the patient is repositioned again, the same technique can be sued to lift the patient 1, and the wedges 400 can then either be placed on another side of the patient, or removed so that the patient lowers to a supine position.

Figure 16A:
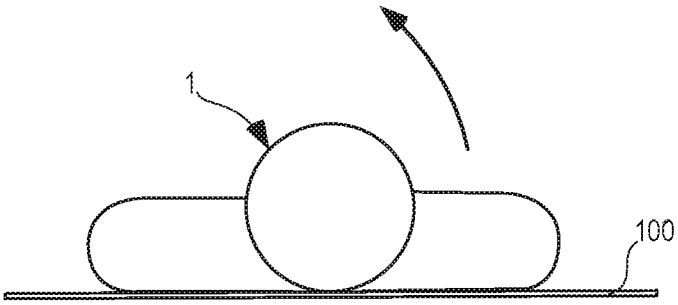
FIGS. 16A-C depict an example of a patient on a patient repositioning apparatus being log-rolled into a recumbent position over a supporting wedge.
Figure 16B:
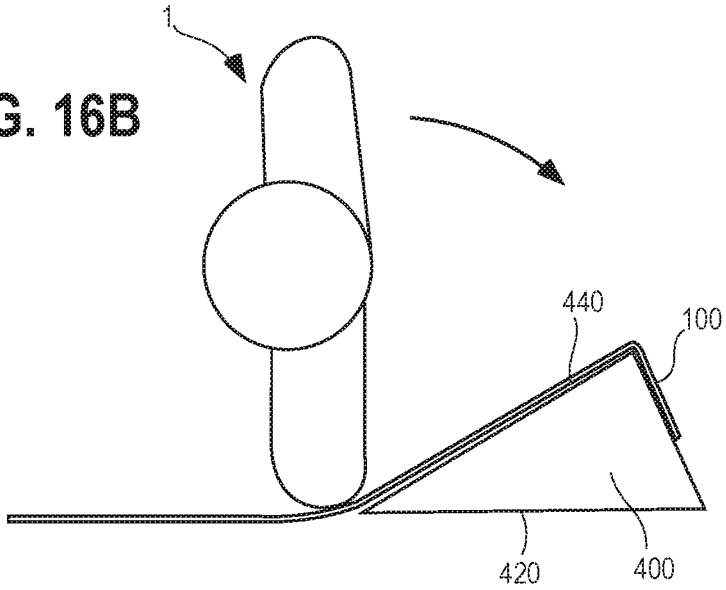
Figure 16C:
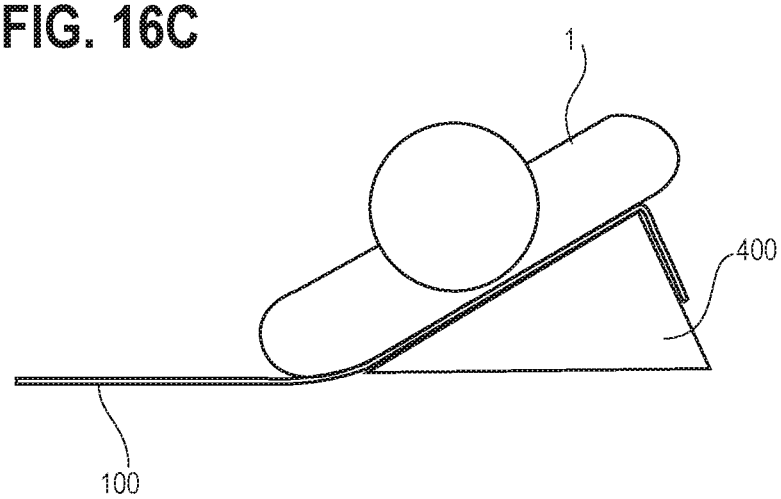

FIGS. 16A-C shows another technique for repositioning a patient 1 relative to wedges 400 using the patient repositioning apparatus 100. In this technique, a caregiver rolls a patient 1 onto the patient's side, and a wedge 400 (or multiple wedges 400) can be pressed against the patient 1, underneath the patient repositioning apparatus 100 as shown in FIG. 16B Once the wedge 400 is in place, the patient 1 can be rolled back onto the wedge 400 in a reclined position, as shown in FIG. 16C.

Figure 11:
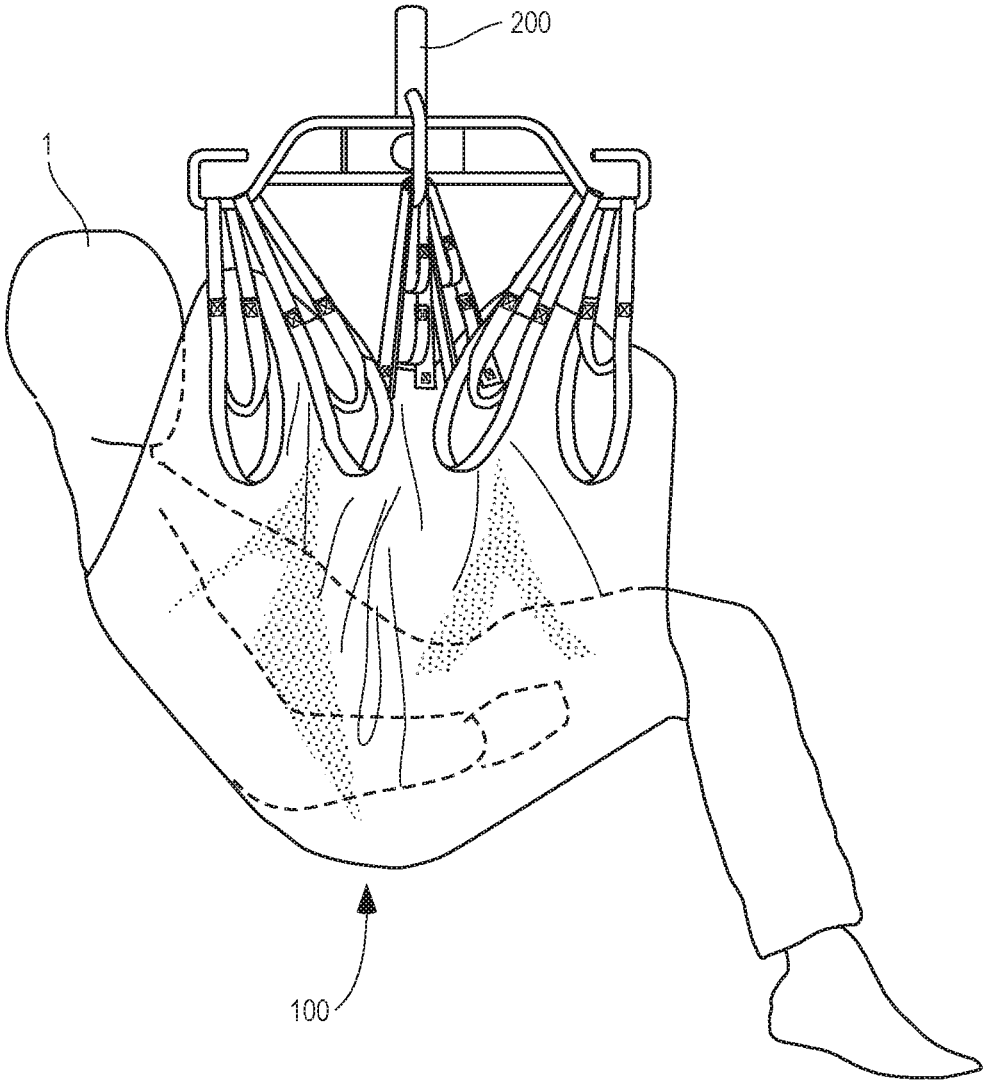
FIG. 11 is a perspective view of a patient supported by a patient repositioning apparatus and in a lifted position.
Figure 17:
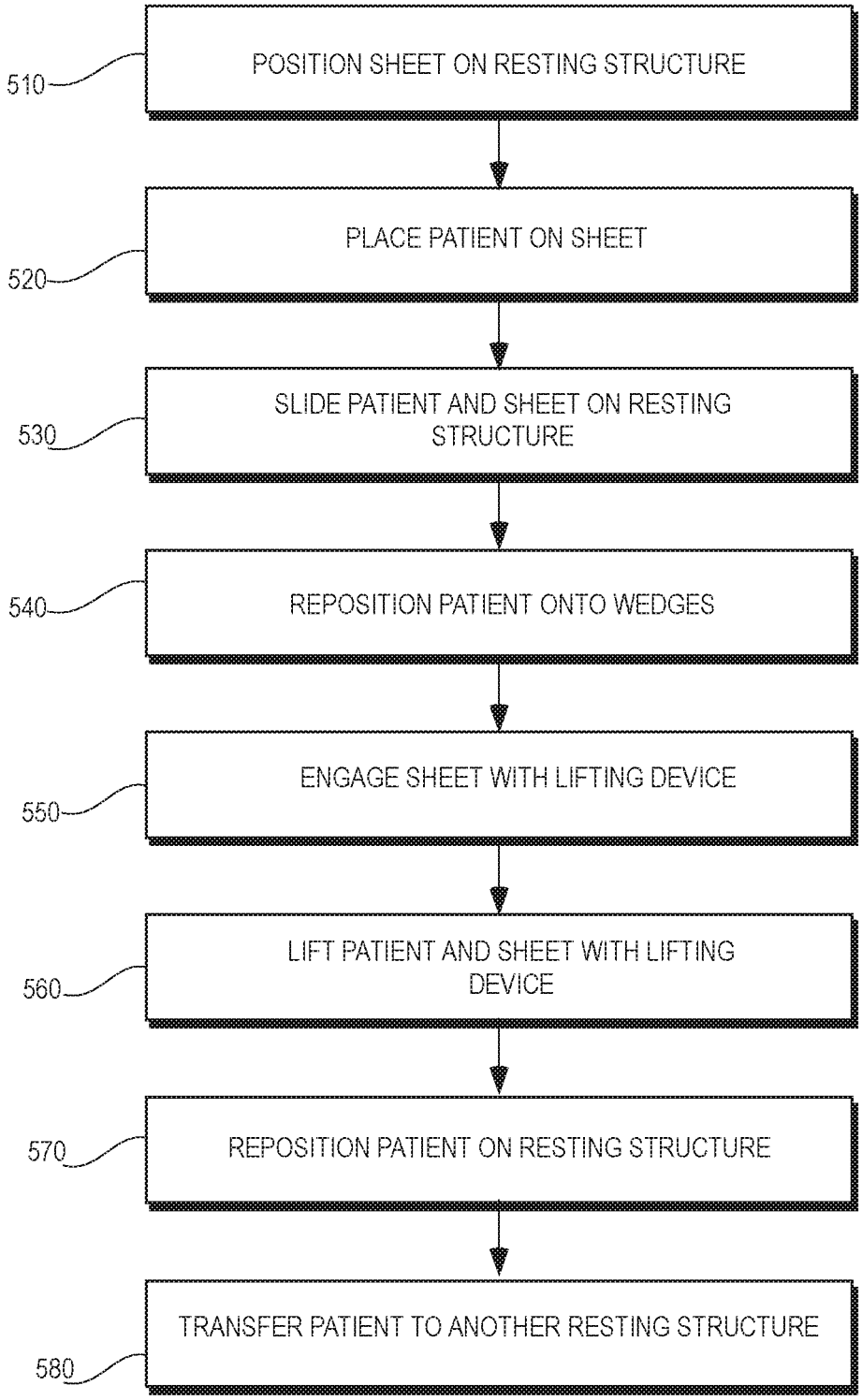
FIG. 17 is a flow diagram depicting exemplary method steps for repositioning and/or transferring a patient using a patient repositioning apparatus.

With reference now to FIG. 17, at step 510 a patient repositioning apparatus (e.g., apparatus 100) is positioned on a resting structure, such as a hospital bed. A patient can be placed or positioned 520 on the resting structure on top of the apparatus and/or sheet. In some instances, the patient may already be lying on the resting structure, and the apparatus can be installed beneath the patient using a log-rolling technique. For example, a caregiver can roll a patient onto their side, place the apparatus on a portion of the resting structure where the patient was previously lying, then roll the patient onto the apparatus on their opposite side, and then extend the remainder of the apparatus over the remainder of the resting structure. From this position on the apparatus, the patient can then be moved, repositioned, or relocated according to a variety of different techniques. In some examples, the patient can be moved by sliding 530 the patient and the patient repositioning apparatus on the resting structure, or to another resting structure. For example, using handles on the patient repositioning apparatus, caregivers may slide 530 the patient to an alternative position on a hospital bed, or slide 530 the patient to another resting structure, such as a gurney placed adjacent to a hospital bed. The patient can also be repositioned 540 onto wedges via one of a variety of methods, including the sliding technique shown described with respect to FIG. 15, the lifting technique described with respect to FIG. 14, or the rolling technique described with respect to FIGS. 16A-C. Additionally, the patient repositioning apparatus can be engaged 550 with a lifting device, for example, by engaging strap members on the patient repositioning apparatus with connector arms on the lifting device. Once engaged, the lifting device can lift 560 the patient off the resting structure. The lifting can lift the patient in a seated position, as shown in FIG. 11, or in a lying position (e.g., a supine position), as shown in FIG. 14. Once lifted, the patient can then either be repositioned 570 on the resting structure, for example, by being placed upon wedges as shown in FIG. 14, or transferred 580 to another resting structure, such as a hospital gurney, a wheel chair, another hospital bed, an operating table, or the like.

One need not necessarily perform all of the aforementioned steps in the order described above. For example, the method may perform the lifting step 560 before the sliding step 530. Further, the method does not necessarily require performance of all of the aforementioned steps. For instance, some methods may only perform one or some of the aforementioned steps. However, where the method involves using examples of a patient repositioning apparatus and the corresponding equipment (e.g., lifting mechanisms, resting structures, wedges, etc.) as disclosed herein, each of the aforementioned method steps would at least be available options.

Uses of singular terms such as "a," "an," are intended to cover both the singular and the plural, unless otherwise indicated herein or clearly contradicted by context. The terms "comprising," "having," "including," and "containing" are to be construed as open-ended terms. Any description of certain embodiments as "preferred" embodiments, and other recitation of embodiments, features, or ranges as being preferred, or suggestion that such are preferred, is not deemed to be limiting. The invention is deemed to encompass embodiments that are presently deemed to be less preferred and that may be described herein as such. All methods described herein can be performed in any suitable order unless otherwise indicated herein or otherwise clearly contradicted by context. The use of any and all examples, or exemplary language (e.g., "such as") provided herein, is intended to illuminate the invention and does not pose a limitation on the scope of the invention. Any statement herein as to the nature or benefits of the invention or of the preferred embodiments is not intended to be limiting. This invention includes all modifications and equivalents of the subject matter recited herein as permitted by applicable law. Moreover, any combination of the above-described elements in all possible variations thereof is encompassed by the invention unless otherwise indicated herein or otherwise clearly contradicted by context. No unclaimed language should be deemed to limit the invention in scope. Any statements or suggestions herein that certain features constitute a component of the claimed invention are not intended to be limiting unless reflected in the appended claims. Neither the marking of the patent number on any product nor the identification of the patent number in connection with any service should be deemed a representation that all embodiments described herein are incorporated into such product or service.

The invention claimed is:

1. A patient repositioning apparatus comprising:

a sheet defining an outer periphery having opposing first and second side edges, the sheet comprising an upper surface material and a single layer of a lower surface material opposite the upper surface material for contacting a resting structure, the lower surface material being a relatively low-friction material as compared to the upper surface material;

a plurality of handles disposed along the first and second side edges;

a plurality of strap members attached to the sheet and distributed across the first and second side edges, each of the strap members comprising: an elongate strap having a first end portion and a second end portion opposite the first end portion, the first end portion of the elongate strap secured to the sheet at a first location and the second end portion of the elongate strap secured to the sheet at a second location separate from the first location to thereby form the elongate strap into a loop extending from the sheet; and each of the strap members comprising a strap portion that forms a bight in the strap member.

2. The patient repositioning apparatus of claim 1, wherein the plurality of handles comprises first and second band portions each being attached to the sheet at a first location and a second location separate from the first location to thereby form a gripping portion that extends between the first and second locations.

3. The patient repositioning apparatus of claim 1, wherein each of the strap members comprises a second strap portion that forms a second bight in the strap member.

4. The patient repositioning apparatus of claim 3, wherein each of the strap members comprises a third strap portion that forms a third bight in the strap member.

5. A kit comprising:

a patient repositioning apparatus comprising:

a sheet having an upper surface and an opposing lower surface, the sheet defining an outer periphery having opposing first and second side edges, the upper surface of the sheet comprising an upper surface material and the lower surface comprising a lower surface material, the lower surface material being a relatively low-friction material as compared to the upper surface material;

a plurality of handles disposed along the first and second side edges; and a plurality of strap members attached to the sheet and distributed across the first and second side edges, each of the strap members comprising:

an elongate strap having a first end portion and a second end portion opposite the first end portion, the first end portion of the elongate strap secured to the sheet at a first location and the second end portion of the elongate strap secured to the sheet at a second location separate from the first location to thereby form the elongate strap into a loop extending from the sheet; and a strap portion connected to the elongate strap at first and second locations spaced along the elongate strap that forms a bight in the strap member, the strap portion having a length greater than the spacing between the first and second locations; and a lifting mechanism comprising a mechanical hoist and a strap connector arm, the strap connector arm comprising a plurality of hooks, the hooks sized to engage strap members from the first side edge and strap members from the second side edge.

6. The kit of claim 5, further comprising at least one wedge, the at least one wedge comprising a base surface and an inclined surface.

7. The kit of claim 6, wherein the inclined surface is formed from the same material as that of the base surface.

8. The kit of claim 6, wherein the inclined surface is formed from a different material from that of the base surface, the material forming the inclined surface being a relatively lower friction material than that of the base surface.

9. The kit of claim 5, wherein the plurality of handles comprises first and second band portions each being attached to the sheet at a first location and a second location separate from the first location to thereby form a gripping portion that extends between the first and second locations.

10. A kit comprising:

a patient repositioning apparatus comprising:

a sheet having an upper surface and an opposing lower surface, the sheet defining an outer periphery having opposing first and second side edges, the upper surface of the sheet comprising an upper surface material and the lower surface comprising a lower surface material, the lower surface material being a relatively low-friction material as compared to the upper surface material;

a first elongate band of the sheet extending along the first side edge;

a second elongate band of the sheet extending along the second side edge;

a plurality of handles disposed along the first and second side edges; and a plurality of strap members including a first plurality of strap members distributed along the first side edge and a second plurality of strap members distributed along the second side edge, each strap member including an elongate strap having first and second end portions, the first end portion of the elongate strap secured to the sheet at a first location and the second end portion of the elongate strap secured to the sheet at a second location separate from the first location, the elongate strap forming a loop and a strap portion connected to the elongate strap at first and second locations spaced along the elongate strap, the strap portion having a length greater than the spacing between the first and second locations; and;

a first plurality of attachment members extending through the first plurality of strap members, the upper and lower surface materials of the sheet, and the first elongate band to attach the first plurality of strap members to the sheet;

a second plurality of attachment members extending through the second plurality of strap members, upper and lower surface materials of the sheet, and the second elongate band to attach the second plurality of strap members to the sheet; and at least one wedge, the at least one wedge comprising a base surface and an inclined surface.

11. The kit of claim 10, wherein the inclined surface is formed from the same material as the base surface.

12. The kit of claim 11, wherein the inclined surface is formed from a different material from that of the base surface, the material forming the inclined surface being a relatively lower friction material than the material forming the base surface.

13. The kit of claim 10, wherein the plurality of handles comprises first and second strap portions each being attached to the sheet at a first location and a second location separate from the first location to thereby form a gripping portion that extends between the first and second locations.

14. The kit of claim 10, wherein each of the strap members comprises a strap portion that forms a bight in the strap member.

15. The kit of claim 10, wherein the attachment members include stitches.

16. A method of repositioning and transferring a patient, the method comprising:

positioning a repositioning apparatus on a first resting structure, the repositioning apparatus comprising a sheet having an upper surface and an opposing lower surface, the sheet defining an outer periphery having opposing first and second side edges, the sheet having a width extending between the first and second edges, the upper surface of the sheet comprising an upper surface material and the lower surface comprising a lower surface material, the lower surface material being a relatively low-friction material as compared to the upper surface material, the repositioning apparatus further comprising a plurality of handles disposed along the first and second side edges and a plurality of strap members attached to the sheet and distributed across the first and second side edges each of the strap members comprising: an elongate strap having a first end portion and a second end portion opposite the first end portion, the first end portion of the elongate strap secured to the sheet at a first location and the second end portion of the elongate strap secured to the sheet at a second location separate from the first location to thereby form the elongate strap into a loop extending from the sheet, the lower surface of the sheet extending uninterrupted across the width of the sheet;

positioning a patient on the repositioning apparatus;

using the handles to slide the repositioning sheet and the patient along an inclined surface of a wedge, thereby positioning the patient in a partially recumbent position relative to the first resting structure;

engaging the strap members of the repositioning sheet with connector arms of a lifting mechanism; and raising the patient and the repositioning sheet via the lifting mechanism.

17. The method of claim 16, further comprising transferring the patient to a second resting structure with the lifting mechanism.

18. A method of repositioning and transferring a patient, the method comprising:

positioning a repositioning apparatus on a first resting structure, the repositioning apparatus comprising a sheet having an upper surface and an opposing lower surface, the sheet defining an outer periphery having opposing first and second side edges, the upper surface of the sheet comprising an upper surface material and the lower surface comprising a lower surface material, the lower surface material being a relatively low-friction material as compared to the upper surface material, the repositioning apparatus further comprising a plurality of handles disposed along the first and second side edges and a plurality of strap members attached to the sheet and distributed across the first and second side edges, each of the strap members comprising:

an elongate strap having a first end portion and a second end portion opposite the first end portion, the first end portion of the elongate strap secured to the sheet at a first location and the second end portion of the elongate strap secured to the sheet at a second location spaced from the first end portion to thereby form the elongate strap into a loop extending from the sheet;

positioning a patient on the repositioning apparatus;

rolling the patient onto a side of the patient;

positioning a wedge against the patient underneath the patient repositioning apparatus and resting the patient on the wedge so that the patient rests in a partially recumbent position relative to the first resting structure;

engaging the strap members of the repositioning apparatus with connector arms of a lifting mechanism; and raising the patient and the repositioning apparatus via the lifting mechanism.

19. The method of claim 18, further comprising transferring the patient to a second resting structure with the lifting mechanism.

20. A method of repositioning and transferring a patient, the method comprising:

positioning a patient repositioning apparatus on a first resting structure, the patient repositioning apparatus comprising a sheet having an upper surface and an opposing lower surface, the sheet defining an outer periphery having opposing first and second side edges, the upper surface of the sheet comprising an upper surface material and the lower surface comprising a lower surface material, the lower surface material being a relatively low-friction material as compared to the upper surface material, the repositioning apparatus further comprising:

a plurality of handles disposed along the first and second side edges;

a first elongate band of the sheet extending along the first side edge;

a second elongate band of the sheet extending along the second side edge;

a plurality of strap members including a first plurality of strap members distributed along the first side edge and a second plurality of strap members distributed along the second side edge each of the strap members comprising: an elongate strap having a first end portion and a second end portion opposite the first end portion, the first end portion of the elongate strap secured to the sheet at a first location and the second end portion of the elongate strap secured to the sheet at a second location separate from the first location to thereby form the elongate strap into a loop extending from the sheet;

a first plurality of attachment members extending through the first plurality of strap members, the upper and lower surface materials of the sheet, and the first elongate band to attach the first plurality of strap members to the sheet; and a second plurality of attachment members extending through the second plurality of strap members, the upper and lower surface materials of the sheet, and the second elongate band to attach the second plurality of strap members to the sheet;

positioning a patient on the upper surface of the sheet;

using the handle to slide the patient and the patient repositioning apparatus from a first resting position to a second resting position;

engaging the strap members of the patient repositioning apparatus with connector arms of a lifting mechanism; and raising the patient and the patient repositioning sheet via the lifting mechanism.

21. The method of claim 20, further comprising transferring the patient to a second resting structure with the lifting mechanism.

* * * * *